United States Patent [19]

Halsell

[11] Patent Number: 4,706,809

[45] Date of Patent: Nov. 17, 1987

[54] PACKAGING CONTAINER FOR AN ELECTRIC MOTOR

[75] Inventor: H. Lee Halsell, Ft. Smith, Ark.

[73] Assignee: The Mead Corporation, Dayton, Ohio

[21] Appl. No.: 907,057

[22] Filed: Sep. 12, 1986

[51] Int. Cl.[4] ..... B65D 85/68

[52] U.S. Cl. ..... 206/319; 206/594; 220/441; 229/23 A

[58] Field of Search ..... 229/23 A, 23 BT, 190, 229/43; 206/591, 594, 814, 592, 319; 220/441

[56] References Cited

U.S. PATENT DOCUMENTS

| | | | |
|---|---|---|---|
| 2,370,749 | 3/1945 | Perkins | 206/594 X |
| 2,995,290 | 8/1961 | Swanson et al. | 229/190 X |
| 3,176,904 | 4/1965 | Collura | 229/190 X |
| 4,331,234 | 5/1982 | Gilbert | 206/591 |

FOREIGN PATENT DOCUMENTS

| | | | |
|---|---|---|---|
| 538727 | 6/1955 | Belgium | 220/441 |
| 2373211 | 8/1978 | France | 229/43 |

*Primary Examiner*—William Price

*Attorney, Agent, or Firm*—Rodgers & Rodgers

[57] ABSTRACT

At item such as an electric motor to be packaged in a container is secured to a mounting board which in turn is disposed within the container in such manner that the mounting board is fixed in position relative to the container by positioning panels secured to the walls of the container and which are somewhat shorter in height than the height of the side and end walls so that a space between an edge of the positioning panels and the bottom wall of the container is provided for snugly receiving the edges of the mounting board thereby to secure the packaged item against jostling within the container.

3 Claims, 7 Drawing Figures

PACKAGING CONTAINER FOR AN ELECTRIC MOTOR

TECHNICAL FIELD

This invention relates to a container for packaging one or more items in such manner that the packaged items are secured against undesired jostling within the container and by a procedure which lends itself to automation.

BACKGROUND ART

Known practices for packaging items such as electric motors within a packaging container have frequently utilized cushioning panels for engaging outer surfaces of the packaged item and such packages frequently have required a substantial amount of time consuming manual operations and have utilized substantial quantities of material.

DISCLOSURE OF THE INVENTION

According to this invention in one form, a container having side, end,. and top walls is provided with positioning means in the form of panels secured to inside surfaces of the container and arranged with their bottom edges spaced somewhat from the bottom edges of the side and end walls of the container to provide a space for receiving edges of a mounting plate to which an item to be packaged is secured or to parts of the packaged item thus insuring that the packaged item is firmly anchored within the package so as to minimize the possibility of undesired jostling movement of the packaged item relative to the container. A bottom may be utilized in some applications of the invention or other suitable means could be employed to engage the mounting plate or parts of the item to be packaged.

BEST MODE OF CARRYING OUT THE INVENTION

Figure 1:
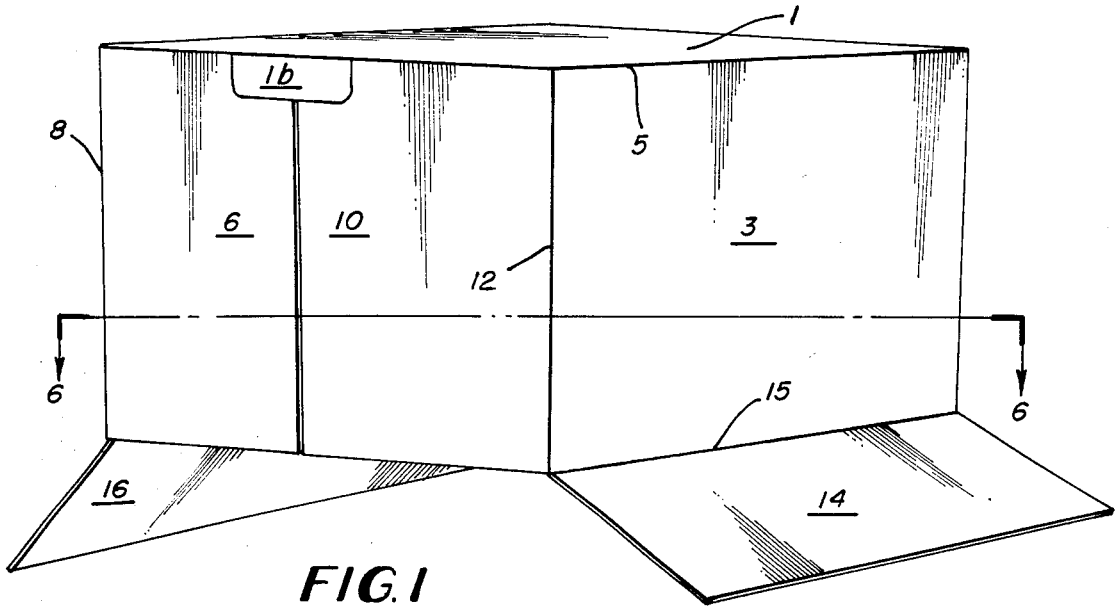
FIG. 1 is a perspective view of a container having top, bottom, side and end walls and which forms the outer components of the package.
Figure 2:
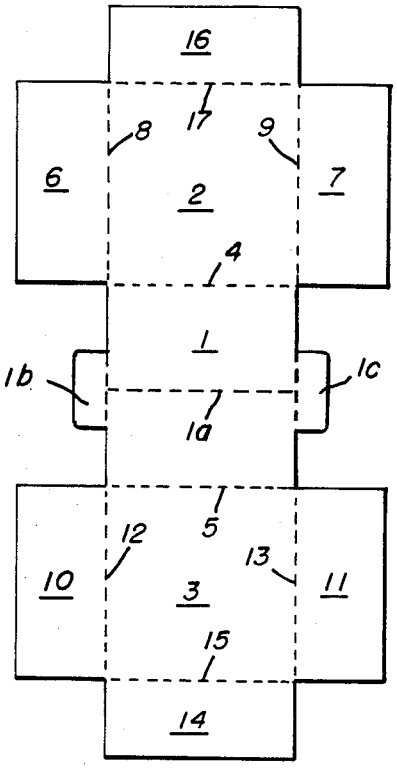
FIG. 2 is a plan view of a blank from which the structure of FIG. 1 is formed.

With reference to FIGS. 1 and 2, the numeral 1 designates the top wall of the container while the numerals 2 and 3 designate side walls which are foldably joined along the fold lines 4 and 5 to the top wall 1. A perforated line 1*a* is formed in top wall 1 to facilitate opening of the package. End wall flaps 6 and 7 are foldably joined to end edges 8 and 9 of side wall 2 respectively. End wall flaps 10 and 11 are foldably joined to side wall 3 along fold lines 12 and 13. Bottom flap 14 is foldably joined to the bottom edge of side wall 3 along fold line 15 while bottom flap 16 is foldably joined to the bottom edge of side wall 2 along fold line 17. While the invention is not limited to particular types of materials, it has been determined that the structure of FIGS. 1 and 2 can be formed of one corrugated inner member glued between two flat facings.

Figure 3:
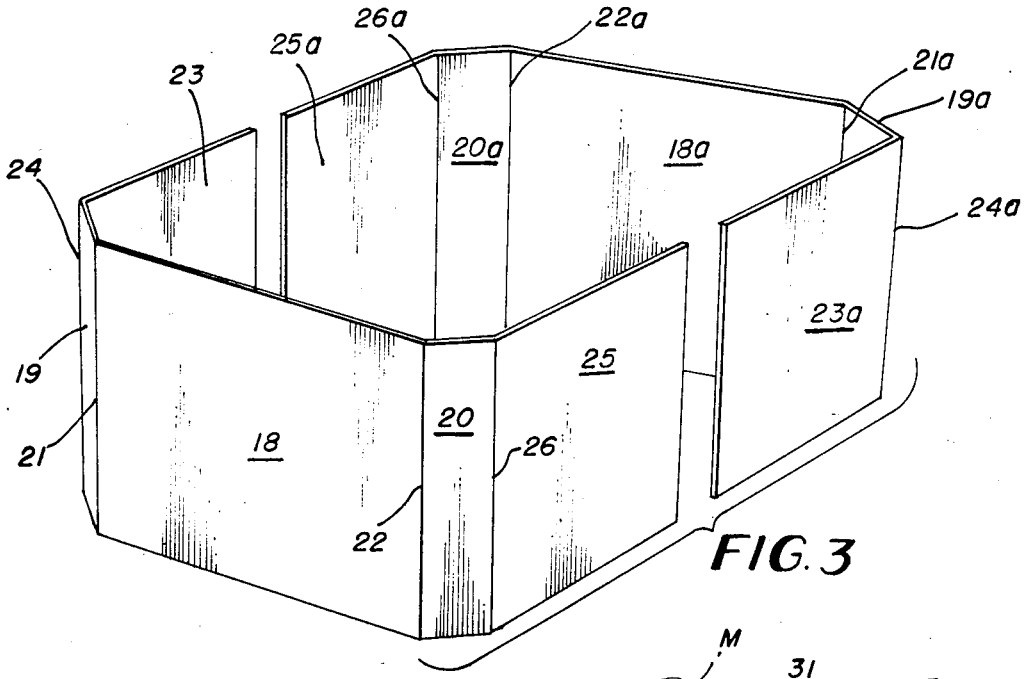
FIG. 3 is a perspective view of positioning panels which are specially constructed according to a feature of this invention and which are inserted into the structure of FIG. 1, the panels of FIG. 3 being of less height than the side and end walls of the structure of FIG. 1 so as to define a positioning ledge at the bottom of these panels.
Figure 5:
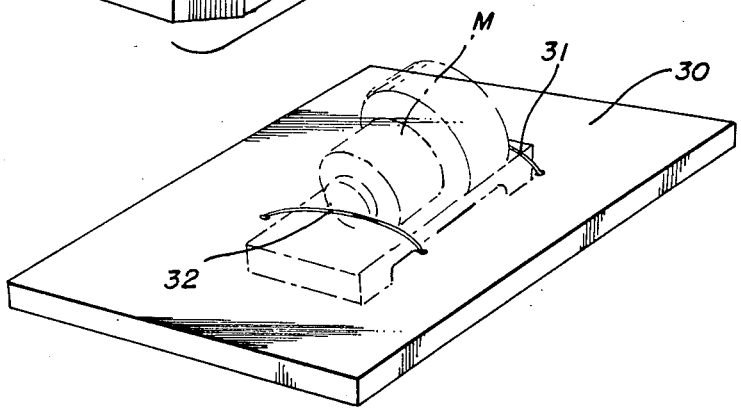
FIG. 5 is a perspective view of a mounting plate to the upper surface of which an item to be packaged such as an electric motor is affixed.
Figure 4:
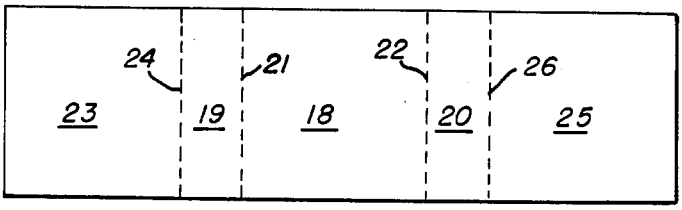
FIG. 4 is a view of the blank for each of the structures shown in FIG. 3.
Figure 6:
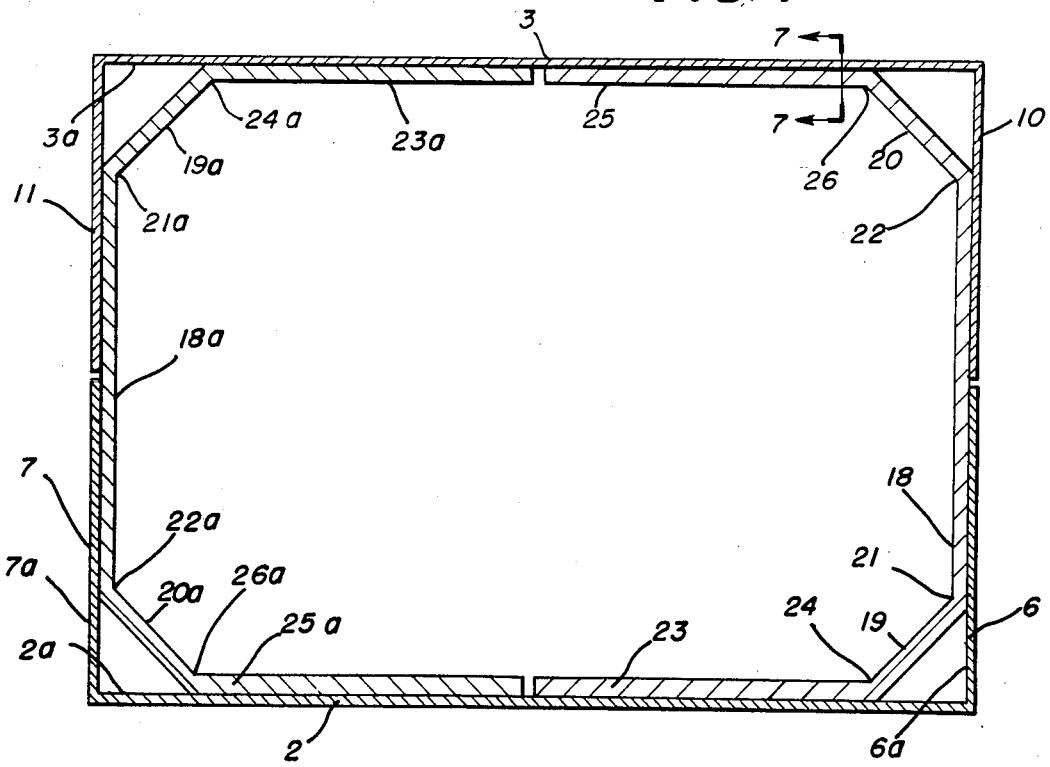
FIG. 6 is a cross sectional view along line 6—6 in FIG. 1 of an assembly including the structure of FIG. 1 into which the structures of FIGS. 3 and 5 have been inserted.

Positioning means formed according to this invention is shown in FIGS. 3 and 4 and includes two structures as shown in FIG. 3 each of which as shown in FIG. 4 includes a main panel 18 to the side edges of which a pair of diagonal panels 19 an 20 are foldably joined along fold lines 21 and 22 respectively. Side panel 23 is foldably joined to diagonal panel 19 along fold line 24 while side panel 25 is foldably joined to diagonal panel 20 along fold line 26. The components designated 18–26 in FIG. 4 are shown as one set of positioning panels in FIG. 3 while another identical set of positioning panels is shown in FIG. 3 and corresponds to the panels of FIG. 4 but are identified by the designation 18*a*–26*a* as is apparent in FIGS. 3 and 6. The complementary panels shown in FIG. 3 are inserted into the container shown in FIG. 1 and are arranged as shown in FIG. 6. The panels of the structure shown in complementary form in FIG. 3 are secured as by adhesive to the side walls 2 and 3 and to the end walls 6, 7, 10 and 11. Tab 1*b* is glued to panel 18 and tab 1*c* is glued to panel 18*a*. Tabs 1*b* and 1*c* reinforce the end walls and hold the panels 6 and 10 and 7 and 11 in proper position. The height of the panels of FIGS. 3 and 4 is somewhat less than the height of the side and end walls of FIG. 1 so as to define a positioning edge at the bottom of the container which is spaced from the bottom wall panels such as 14 and 16 by a distance which is approximately the same as the thickness of the mounting plate 30 shown in perspective in FIG. 5. Preferably the positioning structure of FIGS. 3 and 4 is formed of three flat facings and two intermediate corrugated members to insure adequate stacking strength. The width of the mounting plate 30 is approximately equal to the distance between the inner surfaces such as 2*a* and 3*a* of the side walls 2 and 3 and the length of the mounting plate 30 is approximately equal to the spacing between the inner surfaces such as 6*a* and 7*a* of end panels 6 and 7 respectively. If the packaged item includes a flange or other suitable projection, it may serve as a substitute for the plate 30.

Figure 7:
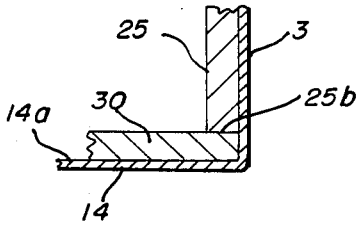
FIG. 7 is an enlarged detailed cross sectional view taken along the line designated 7—7 in FIG. 6.

As is represented in FIG. 7, the lower edge 25*b* of the panel 25 is spaced from the inner surface 14*a* of the bottom panel 14 so as to receive an edge of the mounting plate 30 so that when the bottom closure panels 14 and 16 are closed, the mounting plate 30 is captured between lower edge 25*b* of panel 25 and the inner surface 14*a* of bottom panel 14. Similarly the same gripping relationship applies throughout the perimeter of the container so that all edges except for the very corners of mounting plate 30 are securely and snugly held in position thereby to eliminate undesired jostling of the packaged items such as the electric motor which is fixed in position atop the mounting plate 30 by means of suitable means such as straps 31 and 32. The bottom flaps 14 and 16 may be held closed by suitable known tapes or straps disposed about the package in known manner. If desired, the package may be enveloped by shrink film strapping taping and the like in which it may be possible though not necessary to omit the bottom flaps 14 and 16.

The stacking strength of a container formed according to this invention is substantially enhanced by virtue of the diagonal corner panels 19, 20, 19*a* and 20*a* as is obvious. Furthermore a packaging system utilizing the container as described above is well adapted for automated procedures and thus is capable of effecting substantial economies in time required for formation of the package according to this invention.

While certain panels have been referred to as top wall, bottom flaps and side and end walls, it will be understood that it may be desirable to reorient the package for certain uses of the invention and that the use of such terms is not limiting as to the scope of the invention.

The packaging container and method of packaging according to this invention is well suited for packaging one or more items within a single container where the items must be secured against undesired jostling and where the improved package may be formed by automated high speed procedures.

I claim:

1. A packaging container having side, end, and top walls and arranged to anchor at least one packaged item therein against substantial jostling movement comprises an end flap foldably joined to each end edge of each of said side walls, a tab foldably joined to each end edge of said top wall, means disposed within the container and defining positioning means including a main panel secured by adhesive in flat face contacting relation to said end flaps and to the associated tab at each end of the container, a diagonal panel foldably joined to each end edge of each of said main panels, and side panels foldably joined to each of said diagonal panels and secured by adhesive means in flat face contacting relation to said side walls, said positioning means having a support edge spaced from the bottom of the container, the space between said support edge and said bottom being adapted to receive an element associated with the packaged item in contacting relation with said edge, a pair of bottom flaps foldably joined respectively to the bottom edges of said side walls, and means for securing said bottom flaps closed.

2. A container according to claim 1 wherein a perforated line is formed in said top wall and whose ends coincide with the fold lines between said tabs and said top wall.

3. A packaging container having side, end, and top walls and arranged to anchor at least one packaged item therein against substantial jostling movement comprises an end flap foldably joined to each end edge of each of said side walls, a tab foldably joined to each end edge of said top wall, means disposed within the container and defining positioning means including a main panel secured in flat face contacting relation to said end flaps and to the associated tab at each end of the container, a diagonal panel foldably joined to each end edge of each of said main panels, and side panels foldably joined to each of said diagonal panels and secured in flat face contacting relation to said side walls, said positioning means having a support edge spaced from the bottom of the container, the space between said support edge and said bottom being adapted to receive an element associated with the packaged item in contacting relation with said edge, a pair of bottom flaps foldably joined respectively to the bottom edges of said side walls, and means for securing said bottom flaps closed.

* * * * *